US005647294A

United States Patent [19]

Finley

[11] Patent Number: 5,647,294

[45] Date of Patent: Jul. 15, 1997

[54] BOAT WITH ADJUSTABLE OUTRIGGERS

[76] Inventor: John Finley, 2941 Greenwood Dr., Joplin, Mo. 64804

[21] Appl. No.: 611,389

[22] Filed: Mar. 5, 1996

[51] Int. Cl.[6] ..... B63B 43/14

[52] U.S. Cl. ..... 114/123

[58] Field of Search ..... 114/61, 123

[56] References Cited

U.S. PATENT DOCUMENTS

| | | | |
|---|---|---|---|
| 3,960,102 | 6/1976 | Davy | 116/123 |
| 4,159,006 | 6/1979 | Thurston | 114/123 |
| 4,172,426 | 10/1979 | Susman | 114/61 |
| 4,213,412 | 7/1980 | Jamieson | 114/61 |
| 4,228,750 | 10/1980 | Smith et al. | 114/39 |
| 4,286,533 | 9/1981 | Sanner | 114/39 |
| 4,294,184 | 10/1981 | Heinrich | 114/61 |
| 4,465,008 | 8/1984 | Liggett | 114/39 |
| 4,878,447 | 11/1989 | Thurston | 114/61 |
| 4,898,113 | 2/1990 | Tapley et al. | 114/283 |
| 4,943,250 | 7/1990 | Du Pont | 440/101 |
| 5,277,142 | 1/1994 | Connor | 114/61 |

OTHER PUBLICATIONS

D.C. Greenwood, ed., "Engineering Data for Product Design," McGraw–Hill Book Co., 1961, p. 323.

*Primary Examiner*—Stephen Avila

*Attorney, Agent, or Firm*—Jonathan A. Bay

[57] ABSTRACT

A boat that has a central hull, a pair of floats, and a pair of outrigger spars for supporting the floats on each side of the hull. The outrigger spars are adjustably mounted on the hull so that the floats can be adjustably placed in a given range of positions that lie both (i) substantially spaced away outboard of the side beam of the central hull as well as (ii) substantially spaced rearward of the stern of the central hull. The floats are much smaller than the central hull, partly so that the central hull can be formed with storage recesses in the side-boards thereof for removably storing the floats in a stored position during non-use of the floats. The outrigger spars are preferably mounted to the central hull at or near the opposite rear corners thereof. Also, the outrigger spars are preferably mounted to the central hull for pivotal movement in generally horizontal planes. The boat further includes a set of locking mechanisms between the spars and the central hull, for releasably locking the spars in set positions. Additionally, the spars can be locked in position independently of each other and therefore need not be set in symmetric angles of divergence from the central hull.

14 Claims, 5 Drawing Sheets

BOAT WITH ADJUSTABLE OUTRIGGERS

BACKGROUND OF THE INVENTION

1. Field of the Invention

The invention relates to boat having adjustable outriggers, and, more particularly, to a boat having a central hull from which opposite outrigger spars are adjustably cantilevered for displacement relative to the central hull. The spars are configured for adjustment between such extreme positions that the floats can be located not only in positions outboard of the central hull, but also in various divergent positions, such as simultaneously partly outboard of the central hull's side beam and partly rearward of the central hull's stern (i.e., out and away from the central hull's rear corners).

2. Prior Art

Outriggers appear on a variety of water craft, from seagoing canoes to plural-hull vessels such as catamarans, trimarans and the like. Outriggers appear on canoes and plural-hull vessels in various configurations. The basic outrigger configuration on a seagoing canoe comprises a laterally-extending spar cantilevered at one end to the canoe hull, and terminating in an opposite end that supports a float substantially spaced away from the outboard beam of the canoe hull. The outrigger thereby gives the canoe lateral stability not otherwise present.

The configuration of outriggers for trimarans is similar except that an outrigger structure is mounted on each side of a central hull so that the central hull is flanked by a pair of opposite outrigger floats. Examples, among others, are shown by U.S. Pat. Nos. 3,960,102—Davy, and 4,465,008—Liggett. In some catamaran configurations, a pair of laterally spaced floats are interconnected by spars upon which a central deck is elevated off the water. See, for example, U.S. Pat. Nos. 4,286,533—Sanner, and 5,277,142—Connor.

In addition to the above-listed U.S. patent references, further outrigger configurations are shown by U.S. Pat. Nos. 4,159,006—Thurston, ,4,172,426—Susman, 4,213,412—Jamieson, 4,294,184—Heinrich, and 4,898,113—Tapley et al. (i.e., on a sail-board).

The above-listed U.S. patent references are alike in disclosing floats which are sized on an equivalent scale as the central or main hull of the craft (i.e. equal to at least one-half of, and usually larger than, the geometry of the central or main hull of the craft). Some of the above-listed U.S. patent references disclose adjustable outriggers, and, of these, most have the floats movably mounted for displacement between an extended-out "use" position and a retracted in "storage" position, as for trailering or docking and the like. Only the above-identified reference of Liggett substantially discloses outriggers that swivel in a generally horizontal plane. The rest move differently from swiveling in a horizonal plane.

The reference of Liggett, more particularly, discloses a trimaran sail-craft having a central hull occupying the middle position between two opposite floats. The floats are more like pontoons. That is, each float is more than half as long as the central hull. Also, each float has a plan-view profile greater than half the central hull's plan-view profile. When the floats are swung out to the fully extended position, the bow of the floats align approximately even with the bow of the central hull. When swung back to the fully retracted position, the stern of the floats then align approximately even with the central hull's stern. In the fully retracted position, the float but up against the hull for compactness. Evidently, the size and arrangement given to the Liggett structure is chosen for more convenient land transport and storage, presumably as trailering and docking, whether wet or dry-docking.

There are shortcoming associated with the prior art outrigger configurations. The bows of the outrigger floats typically plow out spray which can fall back on to the deck of the central or main hull, and thereby soak passengers if the spray is not appropriately shielded or blocked by closed decks and the like. Additionally, the prior art outrigger floats, while typically giving the central or main hull effectively greater lateral (or side-to-side) stability, fail to be configured and positioned in arrangements which would give the central or main hull greater fore-to-aft stability. What is needed is an improvement in an outrigger configuration which addresses these shortcomings.

SUMMARY OF THE INVENTION

It is an object of the invention to provide a boat with adjustable outriggers which are adjustable to positions that give the boat better stability both in the lateral side-to-side direction. as well as the fore-to-aft or front-to-back direction.

It is an alternate object of the invention that the above outriggers include floats which are substantially smaller than the main hull of the boat for better storage away when the boat is being trailered over the roadways and the like.

It is an additional object of the invention that the above outriggers be adjustable such that the floats can be set in divergent positions both substantially outboard of the side-beams and substantially rearward of the stern of the main hull.

It is another object of the invention that the above outriggers be independently adjustable and then releasably lockable in the set position.

It is a further object of the invention that the boat be formed with recesses in the main hull for removably storing the floats in a stored position during non-use of the floats.

These and other aspects and objects are provided according to the invention in a boat that has a central hull, a pair of floats, and a pair of outrigger spars for supporting the floats on each side of the hull. The outrigger spars are adjustably mounted on the hull so that the floats can be adjustably placed in a given range of positions that lie both (i) substantially spaced away outboard of the side beam of the central hull as well as (ii) substantially spaced rearward of the stern of the central hull.

The floats are much smaller than the central hull. One advantage in that is that the central hull can be formed with storage recesses in the side-boards thereof for removably storing the floats in a stored position during non-use of the floats.

The outrigger spars are preferably mounted to the central hull at or near the opposite rear corners thereof. Also, the outrigger spars are preferably mounted to the central hull for pivotal movement in generally horizontal planes.

The boat further includes a set of locking mechanisms between the spars and the central hull, for releasably locking the spars in set positions. Additionally, the spars can be set independently of each other and therefore need not be set in symmetric angles of divergence from the central hull. A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
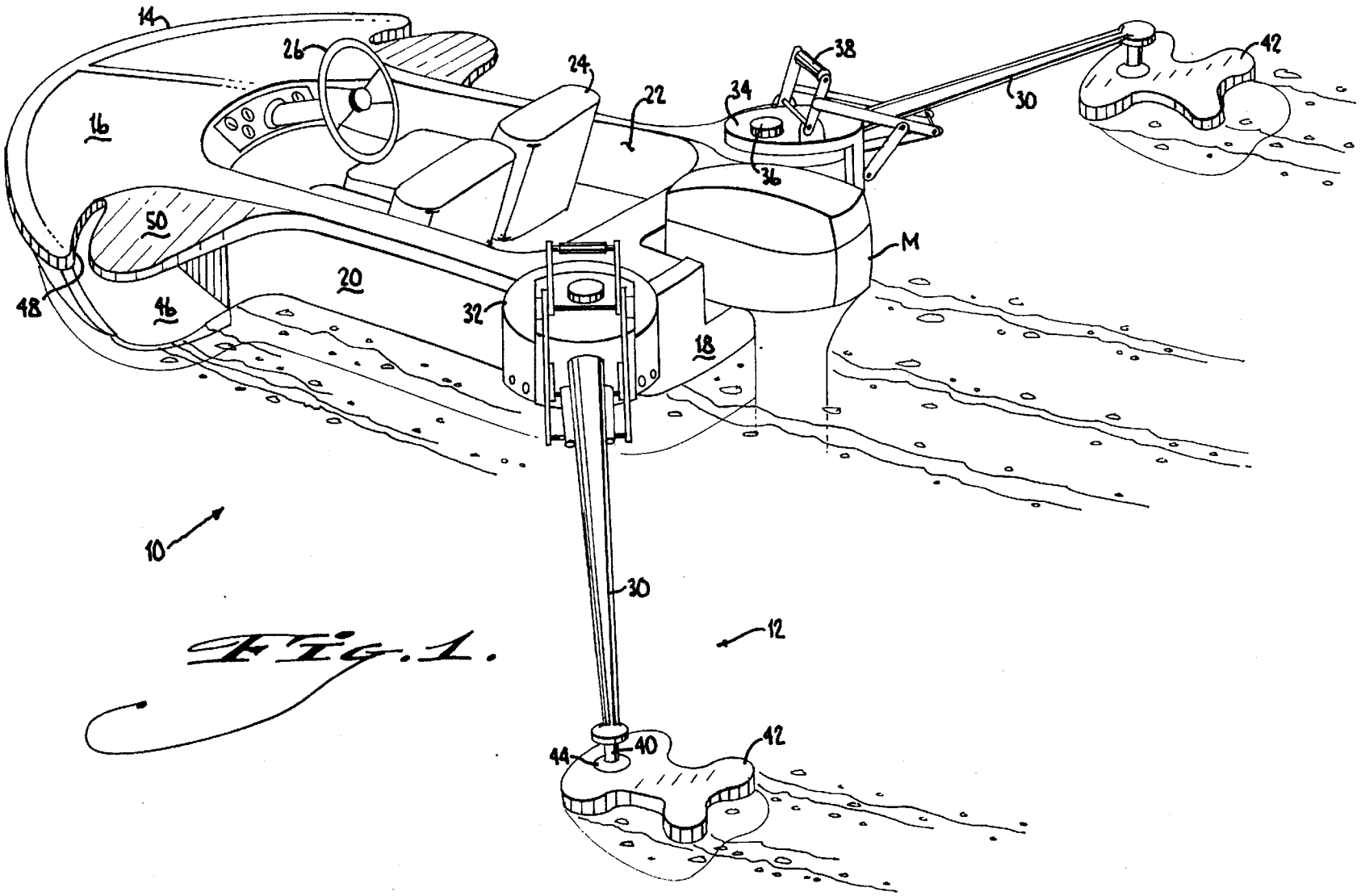
FIG. 1 is a perspective view of a boat with adjustable outriggers in accordance with the invention.
Figure 2:
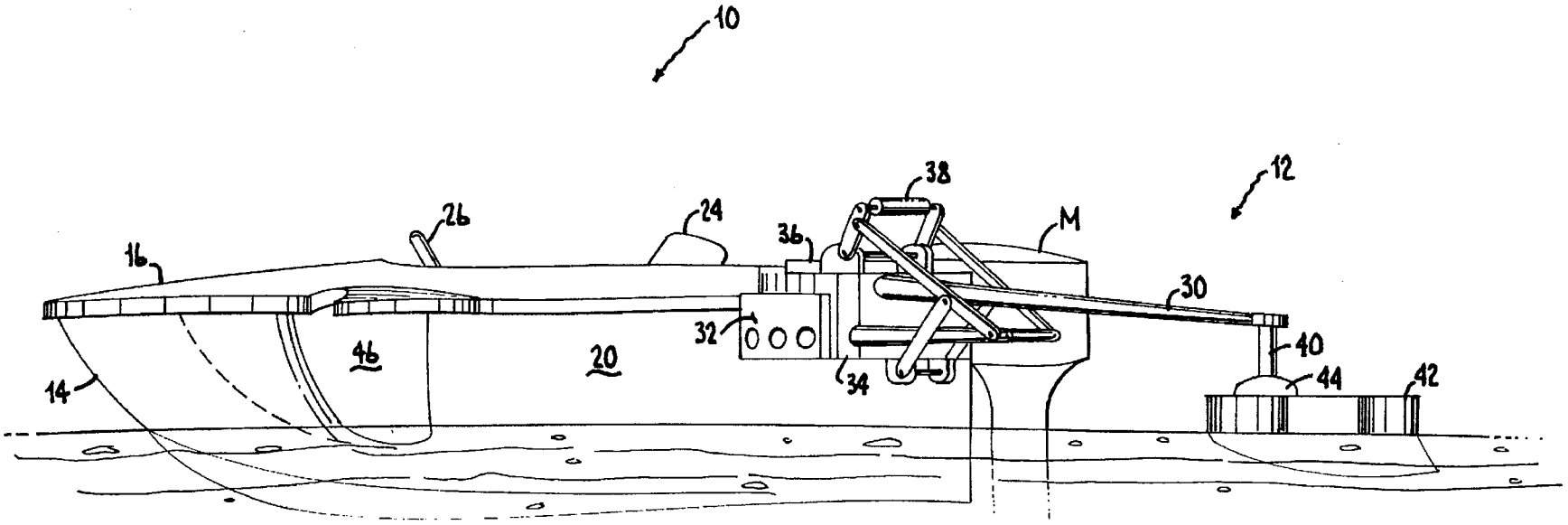
FIG. 2 is a side elevational view thereof.
Figure 3:
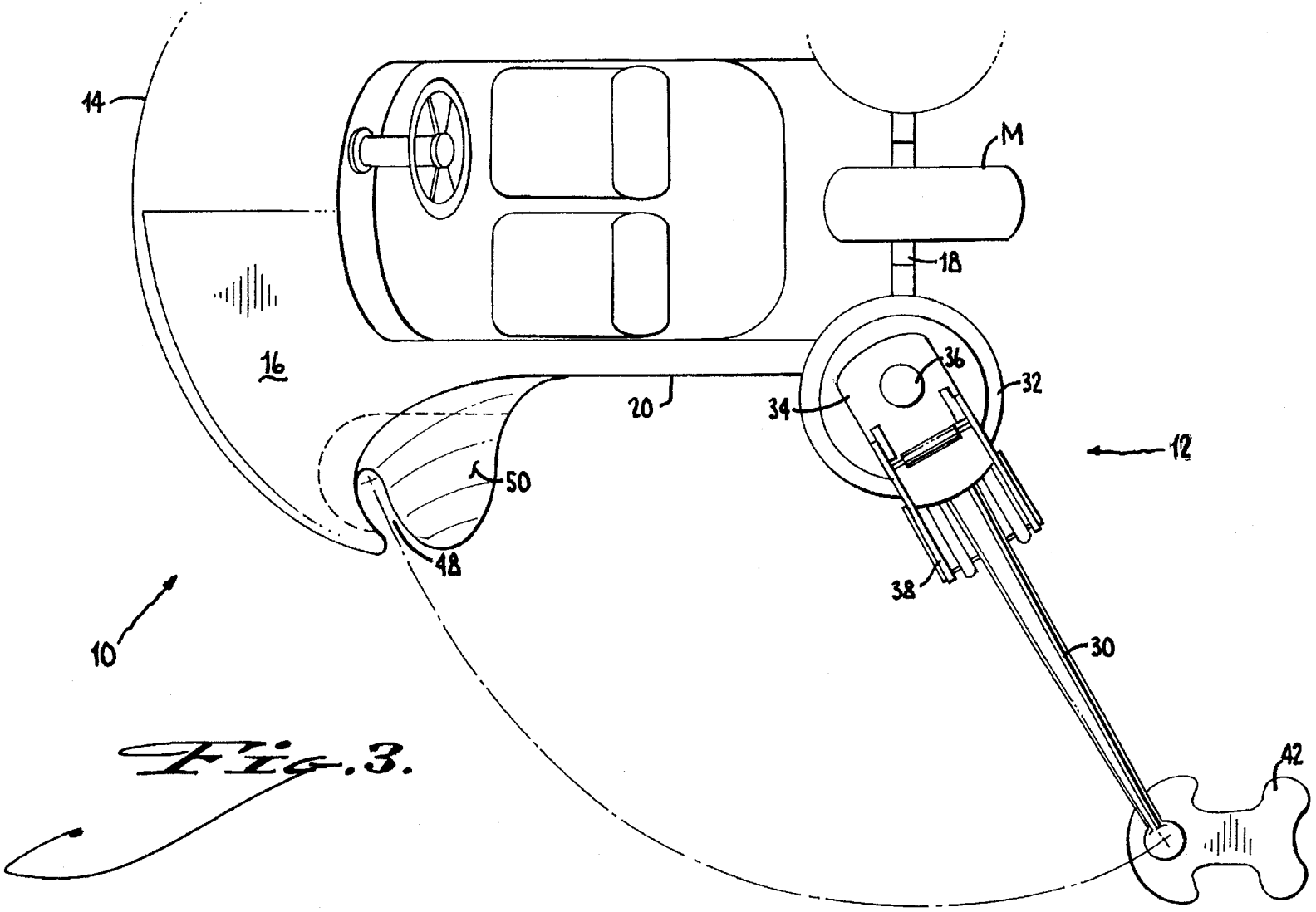
FIG. 3 is a top plan view thereof, with portions broken away.

In FIGS. 1 through 3, a boat 10 with adjustable outriggers 12 in accordance with the invention is shown powered by an outboard motor M. In the drawings, the boat 10 is a motor-propelled boat. However, the adjustable outriggers 12 in accordance with the invention can be deployed on other water craft as well and, accordingly, the depiction and description here of a motor-propelled boat is used merely for convenience in this specification and does not limit the invention.

The boat 10 comprises a central or main hull 14 having an enlarged bow 16, an enlarged stern 18 across the middle of which the motor M is mounted, and a necked-in intermediate portion 20 extending between the bow 16 and stern 18. The main hull 14 also has a passenger compartment 22 carrying a pair of passenger seats 24, and a steering wheel 26 which, along with other accessories (not shown), are customary on motor-powered boats of this type.

The preferred configuration of this boat hull 14 (i.e., excluding the outriggers 12 and motor M) is given a bow-to stern length of about 12 feet (3.6 m) and a beam-to-beam width of about 5 feet (1.5 m). The boat 10 preferably retains this size when the outriggers 12 are fully swung forward in the extreme forward position (i.e., the "storage position, not shown). This would be advantageous for various purposes, such as, for example, for more convenient trailering over the roadways or for passage through narrow inlets, and the like. Additionally, the boat 10 (including the outriggers 12 but excluding the motor M) preferably weighs generally between 200 and 250 pounds (90 and 115 Kg) for convenience of hoisting up off the water or towing in the water, as a dinghy, as to service a larger craft. The preferred utility for the boat 10 would include duties as a seagoing fishing boat with capabilities of squeezing through narrow inlets (with the outriggers stored) as well as negotiating moderately swelling seas at open speeds (with the outriggers deployed in "use" positions as shown).

One inventive aspect here concerns the outriggers 12. There are two opposite outrigger spars 30 mounted on the left and right extreme rear corners 32 of the boat hull 14. These corners 32 are given at least a semi-circular turret shape and carry swivel-mounted brackets 34 in which the outrigger spars 32 are securely cantilevered. The swivel-brackets 34 are attached to the turret corners 32 via swivel pins 36. The swivel-brackets 34 include locking mechanisms 38 which will be more fully described below.

The spars 30 are given a cross-sectional shape of a tear-drop, as is usually seen in sail-boat masts, to reduce drag through the air and/or water while moving forward. Each spar 30 extends to a terminal end that carries a down-link 40 that connects to a float 42. Each down-link 40 terminates, at its lower end, in a ball structure to insert in a complementary socket structure in the float 42 to form a ball-and-socket joint 44 between the down-link 40 and the float 42.

As shown better by FIG. 3, each float 42 has plan-view profile that mimics the plan-view profile of the boat hull 14 except for being a smaller scale version. The socket structure 44 that is formed in the float 42 is located on the axis of symmetry of the float relative to side-to-side symmetry thereof, but otherwise is located relatively forward of the center of geometry of the float's plan-view profile. FIG. 2 shows the appearance of the floats 42 (left side only shown in FIG. 2) in respect of their side-view profile. From the side-view vantage point, the floats 42 are relatively deep or thick. This gives the floats 42 increased buoyancy or flotation so that they won't easily sink or plow deeply into oncoming waves when moved forwardly at the open speeds of the boat 10.

With general reference again to FIGS. 1 through 3, the outrigger spars 30 are about 8 feet (2.4 m) long. If the outriggers 12 are positioned to extend straight out from the sides of the boat hull 14 (such extension not shown), the floats 42 would be spaced about 21 feet (6.4 m) apart. As shown in FIGS. 1 through 3, the outriggers 12 are positioned to form a tripod arrangement among the floats 42 and main hull 14. This is a preferred arrangement for the purpose of at least keeping the spray that the floats 42 plow up from coming back onto the passengers in the passenger compartment 22. The tripod arrangement also gives other advantages too. The tripod arrangement acts to dampen not only the lateral or side-to-side rolling of the main hull 14, but also fore-to-aft pitching. Put differently, the tripod arrangement increases not only the lateral stability of the boat hull 14, but also the front-to-back stability as well.

The outrigger spars 30 can be made of any suitable material, such as aluminum or a polymer or resinous material, so that the spars 30 can deflect upwardly or downwardly when the main hull 14 rolls. The quality and quantity of deflection that is designed into the spars 30 is chosen to optimize the rolling and pitching stability of the main hull 14. When the main hull 14 rolls, it acts to sink or depress one float 42 deeper into the water while simultaneously acting to lift the other float 42 out of the water. If the spars 30 are too stiff, the rolling hull 14 will achieve the undesirable result of just that, i.e., sinking one float 42 while lifting the other. This would be undesirable because the main hull 14 would experience great drag from the sunken float 42 while feeling effectively no drag from the elevated float 42. Then the main hull 14 would be pulled or turned in the direction of the sunken float 42.

When the spars 30 are designed to deflect or yield properly when the main hull 14 rolls, one float 42 would merely be depressed slightly deeper into the water while the other float 42 would ride relatively shallower, but there would not be as great as a difference between the two drag forces that the floats 42 impart to the main hull 14. That way there would not be as much of an imbalanced force that would pull the steering of the main hull 14 in one direction or the other.

Another inventive aspect here concerns the shape and arrangement of the bow 16 of the main hull 14. It includes a pair of inboard recesses 46 configured to store the floats 42 when swung forward to the fully retracted "storage" position (not shown). That is, the spars 30 can be swung forwardly until the floats 42 come to nest in their respective recesses 46. The recesses 46 are configured to fit closely against the floats 42 on at least four sides, which four sides would be—if the floats 42 are likened to a six-sided cube for descriptive purposes only—namely, the upper and lower sides, and the forward and inboard sides. The recesses 46 are open on the outboard and rearward sides of the floats 42. The enlarged bow 16 is given such a shape as shown to shroud the floats 42 when they are stored (not shown). The recesses 46 are preferably open in the rearward area to avoid catching and plowing water when the floats 42 are deployed in "use" positions (i.e., exemplary "use" positions are shown by FIGS. 1 through 3).

The boat hull 14 includes opposite arcuate slots 48 above the recesses 46 to allow the removable passage of the down-links 40 when the floats 42 are either swung in or out of the recesses 46. Portions 50 of the top surface of the boat hull 14—which portions 50 are aft of the arcuate slots 48—are beveled to function as cam surfaces upon which the spars 30 ride when the floats 42 are swung in and out of the recesses 46. The bevel or cam surfaces 50 particularly coact with the spars 30 to ease the alignment of the down-links 40 with the slots 48 and/or ease the alignment of the floats 42 in the recesses 46 when a user is attempting to store and nest the floats 42 in the recesses 46.

Figure 4:
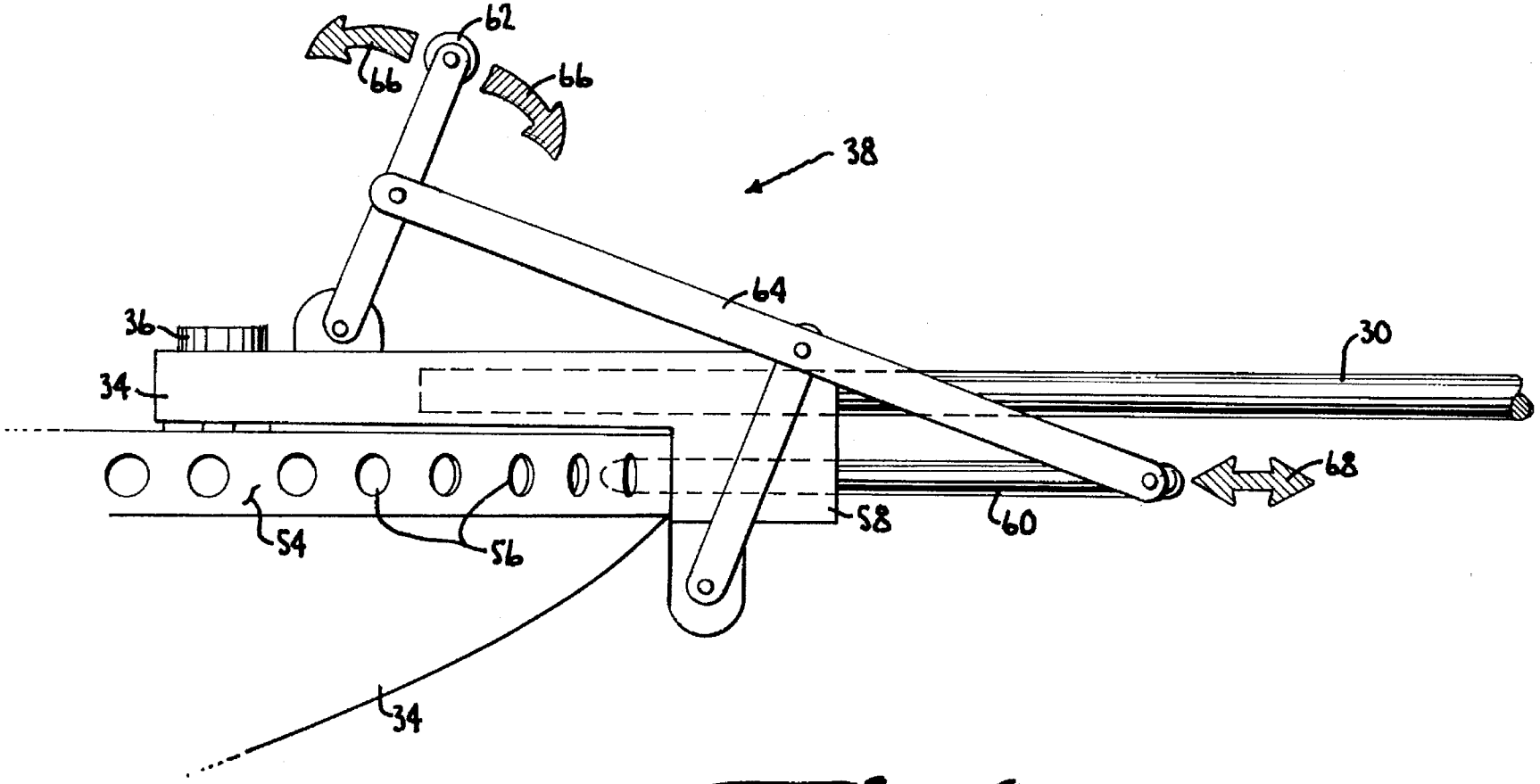
FIG. 4 is an enlarged elevational view taken in the direction of arrows IV—IV in FIG. 3; and, FIG. 5 is a top plan view of FIG. 4.
Figure 5:
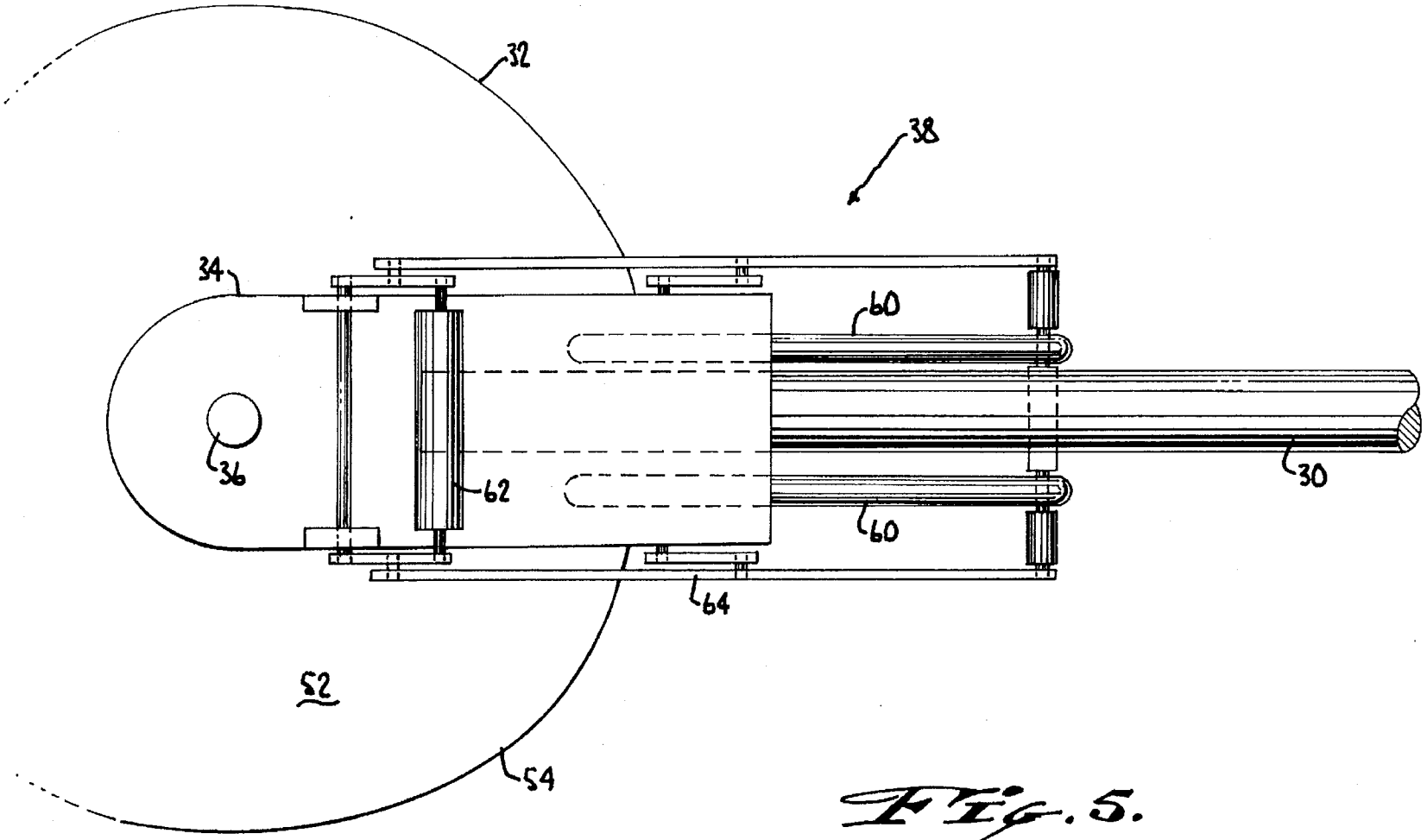

A further inventive aspect here relates to the cooperation between the swivel-brackets 34 and the turrets 32, as is better shown by FIGS. 4 and 5. The opposite turret structures 32 (left side only shown in FIGS. 4 and 5) define at least a semi-circular flat top 52 delimited by a cylindrical hoop of an edge 54 in which are formed a series of holes 56 (see FIG. 4) spaced every 10° apart between centers. The swivel-bracket 34 is attached to the turret structure 32 by the swivel pin 36 that protrudes up from the axial center of geometry of the turret structure 32. The swivel-bracket 34 extends to terminate in a skirt portion 58 (see FIG. 4) which closely conforms to the hoop edge 54 of the turret structure 32. The swivel-bracket 34 carries the locking mechanism 38 which includes a pair of spaced locking pins 60 for reversibly inserting in any given pair of two holes 56, but which pair of holes 56 are spaced apart by an unused hole 56 immediately therebetween (the arrangement of the two pins 60 being so spaced as to align with two holes 56 spaced by another hole 56 is not shown).

As FIG. 4 shows, the locking pins 60 are actuated by a hand-crank 62. There is a system of actuating links between the hand-crank 62 and the locking pins 60, which links, together with the hand-crank 62, form a four-bar linkage 64. This particular configuration of a four-bar linkage is known in standard reference books as a "D-drive linkage." See, e.g., D. C. Greenwood, ed., "ENGINEERING DATA FOR PRODUCT DESIGN," McGraw-Hill Book Co., 1961, p. 323. An aspect of this linkage configuration 64 is that a given circular input motion (e.g., as indicated by arrows 66 in FIG. 4) is converted into a linear output motion (which is indicated by arrow 68 in FIG. 4). Given the foregoing description of the turret structure 32 and swivel-bracket 34, the spars 30 can be locked in various positions in 10° increments between extreme positions of straight forward and straight rearward (or further), which extreme positions are at least 180° apart.

A still further inventive aspect here is that the spars 30 are independently adjustable. That way, if the prevailing direction of the waves on the sea is from a side of the boat 10, the leeward float 42 can be positioned relatively more straight out from the side of the main hull 14 while the windward float 42 can be positioned relatively more rearwardly. Other arrangements are possible too and would be indeed more preferable for other situations.

Advantages of the invention include the following. The inventive outriggers 12 are adjustable to positions where they not only dampen the rolling of the main hull 14, but also act to dampen the fore-to-aft pitching. To so this, the outriggers 12 can be placed in positions to increase side-to-side stability as well as front-to-back stability. Therefore, the outriggers 12 effectively give the main hull 14 the stability of a craft that has a comparably greater width and length. Also, the two outriggers 12 are much more adjustable than previous configurations, and are independently adjustable as well. Furthermore, the floats 42 can be set in positions where the spray that they plow up does not fall into the passenger compartment 22. This advantage is particularly acute for relatively fast, motor-powered boats, but would be advantageous also for sail-craft too. Additionally, the outrigger spars 30 are given such flexibility so as to reduce the pull on the main hull 14 that results when one float 42 is sunk much deeper in the water than the other. And—whereas this list of advantages is not exhaustive—another advantage given by the invention is the location of the down-link 40 connection 44 on the float 42. It is located forward of the center of geometry of the float 42. That arrangement promotes better parallel alignment of the long axis of the float 42 with the direction of travel of the main hull 14.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A boat having:

a hull having a bow and a stern and opposite side beams, a pair of floats, outrigger spars for supporting the floats on each side of the hull, wherein each float is given a size and shape substantially smaller than the boat hull and, each float includes an inboard and an outboard side extending between a bow and a stern of the float, the inboard sides of the floats being the sides that are relatively nearer the boat hull than the respective outboard sides, the outrigger spars being relatively elongated and being adjustably mounted on the hull proximate the opposite rear corners of the hull so that the floats can be adjustably placed in a given range of positions that lie generally between extremes of substantially spaced away outboard and substantially spaced away aft of the side beam and stern, respectively, of the boat hull, which given range of positions thereby substantially comprises various tripod arrangements of the hull and floats in which, under forward transit, the hull relatively leads the relatively trailing floats such that, the bows of the floats are spaced substantially behind a plane containing the stern of the boat hull, and, the inboard sides of the floats are spaced substantially outboard from the nearer side beam of the boat hull, whereby a user can choose from the given range of positions to stabilize the fore-to-aft inclination or pitching of the boat hull in accordance with boat speed and wave conditions.

2. The boat of claim 1, wherein the boat hull further comprises a pair of opposite recesses formed in the sides of the boat hull for removably receiving the floats in a stored position during non-use of the floats.

3. The boat of claim 1, wherein the outrigger spars are adjustably mounted to the boat hull such that the spars are pivotable in generally horizontal planes.

4. The boat of claim 1, further comprising locking mechanisms interconnected between the outrigger spars and the boat hull to releasably lock the spars in given positions.

5. A boat having:

a main hull having a bow and a stern and opposite side beams, a pair of floats, outriggers for supporting the floats, wherein each float has its own hull which is sized and shaped substantially smaller than the main boat hull, each float hull defining at least a bow thereof, the outriggers being adjustably mounted to the main boat hull for adjustable placement in various positions ranging generally from (i) an extreme outward position in which the floats are generally straight outboard and spaced substantially away from the outboard beam of the main boat hull, to (ii) an extreme rearward position in which the bows of the floats are generally straight rearward and spaced substantially rearward of a plane containing the stern of the main boat hull, whereby a user can choose a given position for the floats from among the various positions between the extremes in order to stabilize the fore-to-aft pitching as well as side-to-side rolling of the main hull in accordance with boat speed and wave conditions.

6. The boat of claim 5, wherein the main boat hull further comprises a pair of opposite recesses formed in the sides of the main boat hull for removably receiving the floats in a stored position during non-use of the floats.

7. The boat of claim 5, wherein the outriggers are adjustably mounted to the main boat hull proximate the opposite rear corners thereof.

8. The boat of claim 5, wherein the outriggers are adjustably mounted to the main boat hull such that the outriggers are pivotable in generally horizontal planes.

9. The boat of claim 5, further comprising a locking mechanisms interconnected between the outriggers and the main boat hull to releasably lock the outriggers in given positions.

10. A boat having:

a main hull having a bow and a stern and opposite side beams, a pair of capsizing-resistance members, outriggers for supporting the capsizing-resistance members, wherein each capsizing-resistance member is sized and shaped substantially smaller than the main boat hull, and is hydrodynamically formed such that the member can hydrodynamically plane under a given forward velocity and experience hydrodynamic lift:

each capsizing-resistance member having a given surface portion that is the foremost part of the member that forms a bow wave under forward velocity:

the outriggers being adjustably mounted to the main boat hull for adjustment among various positions of generally outboard and rearward such that said given surface potions of the capsizing-resistance members lie spaced substantially behind a plane containing the stern of the main hull, wherein a user can choose a given position for the capsizing-resistance members from among the various available positions in order to stabilize the fore-to-aft pitching as well as side-to-side rolling of the main boat hull in accordance with boat speed and wave conditions.

11. The boat of claim 10, wherein the main boat hull further comprises a pair of opposite recesses formed in the sides of the main boat hull for removably receiving the capsizing-resistance members in a stored position during non-use of the capsizing-resistance members.

12. The boat of claim 10, wherein the outriggers are adjustably mounted to the main boat hull proximate the opposite rear corners thereof.

13. The boat of claim 10, wherein the outriggers are adjustably mounted to the main boat hull such that the outriggers are pivotable in generally horizontal planes.

14. The boat of claim 10, further comprising locking mechanisms interconnected between the outriggers and the main boat hull to releasably lock the outriggers in given positions.

* * * * *